United States Patent [19]

Limousin

[11] 4,441,298

[45] Apr. 10, 1984

[54] NESTING MODULAR ELEMENTS, AND THEIR METHOD OF ASSEMBLY

[76] Inventor: Louis Limousin, 3bis rue Nicolas Leblanc, 18000 Bourges, France

[21] Appl. No.: 180,831

[22] Filed: Aug. 25, 1980

[30] Foreign Application Priority Data

Aug. 24, 1979 [FR] France ..... 79 21718

[51] Int. Cl.[3] ..... E04C 1/10

[52] U.S. Cl. ..... 52/594; 52/604

[58] Field of Search ..... 52/594, 596, 603, 604, 52/606; 46/25

[56] References Cited

U.S. PATENT DOCUMENTS 2,319,914 5/1943 Blanding, Jr. ..... 46/25
3,487,579 6/1970 Brettingen ..... 52/594 X
4,107,894 8/1978 Mullins ..... 52/606 X

FOREIGN PATENT DOCUMENTS 846911 7/1949 Fed. Rep. of Germany ..... 52/594
1265638 4/1968 Fed. Rep. of Germany ..... 46/25
2221036 10/1974 France .
528713 2/1955 Italy ..... 52/594

*Primary Examiner*—Carl D. Friedman
*Attorney, Agent, or Firm*—Eric P. Schellin

[57] ABSTRACT

Nesting modular elements to be used whole or divided into fractions thereof the hole element comprises a solid central core. At each corner of the upper face is located a projecting frusto-pyrimidal projection. The lower face of the element has a closed recess internally thereof for engaging projection portions of similar modular elements.

5 Claims, 9 Drawing Figures

FIG.1
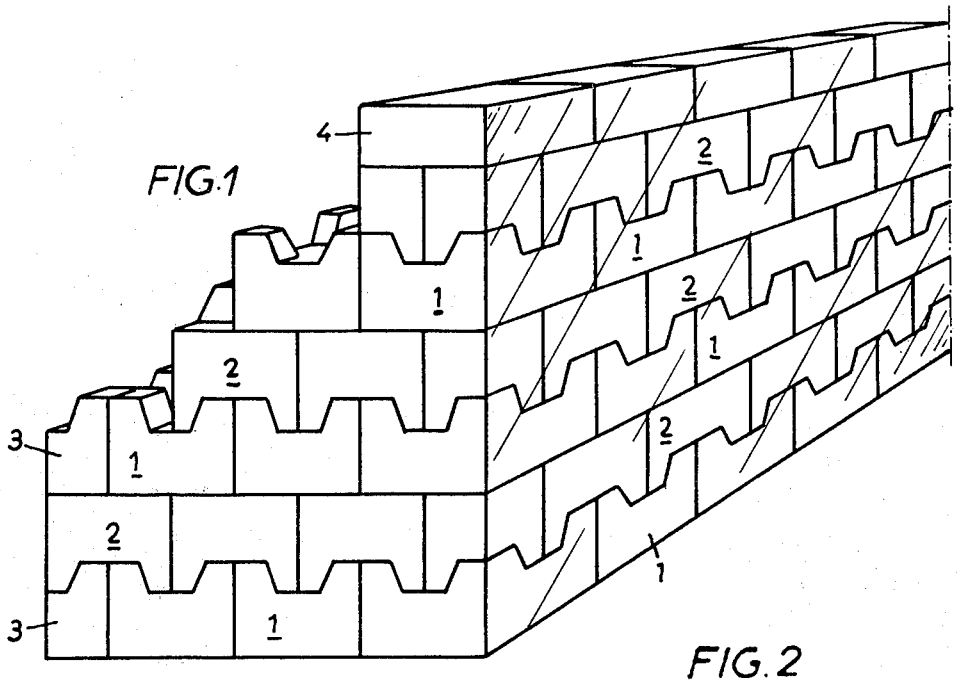
FIG.2
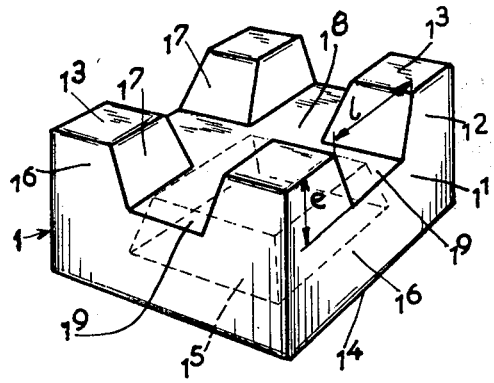
FIG.3
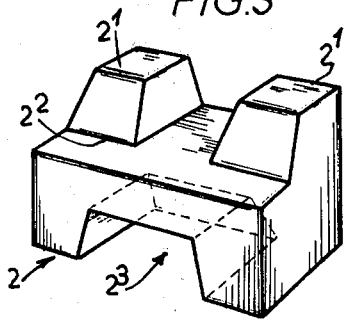
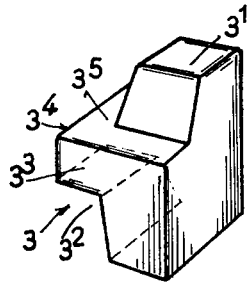
FIG.4

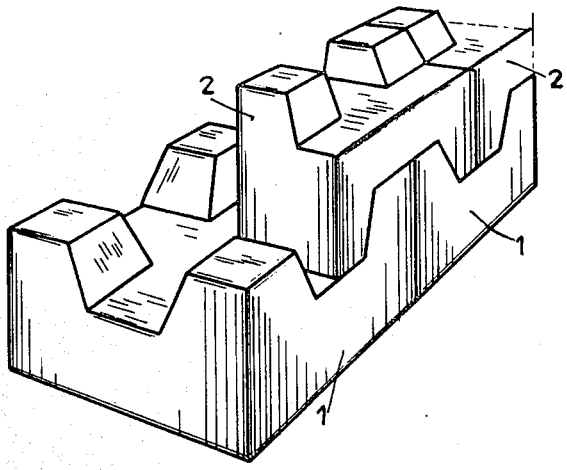
FIG. 5
FIG. 6
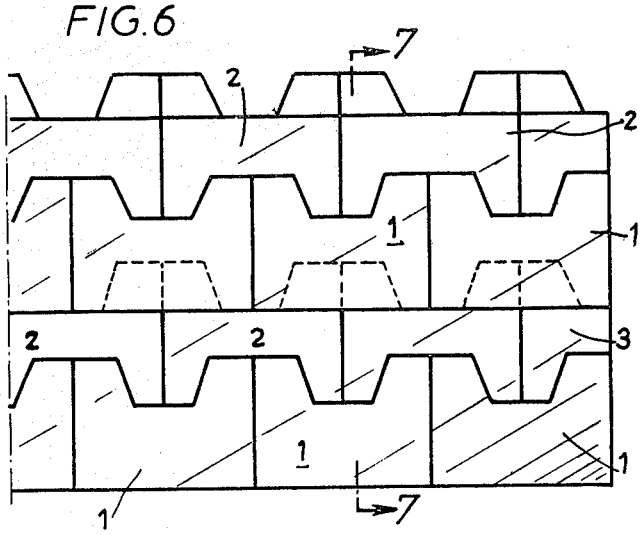
FIG. 7
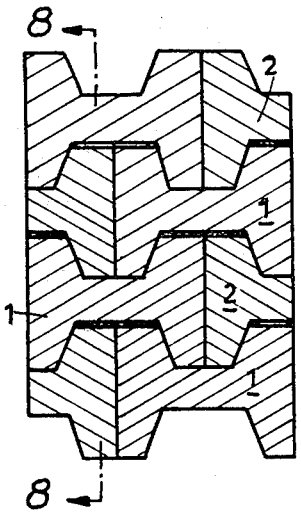
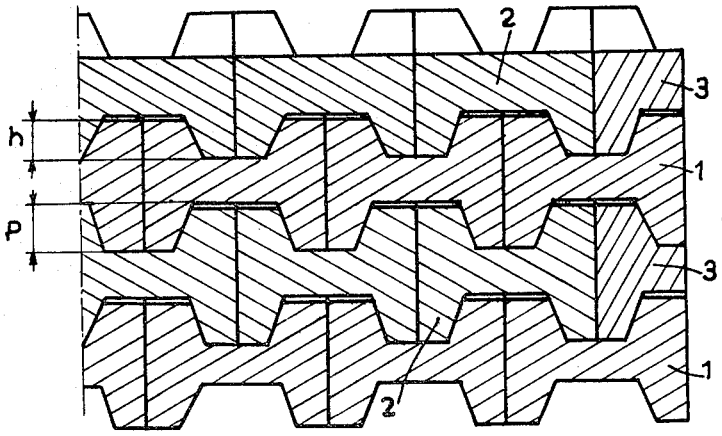
FIG. 8

NESTING MODULAR ELEMENTS, AND THEIR METHOD OF ASSEMBLY

The invention relates to nesting modular elements, and to their method of assembly.

The invention belongs to the technical field of the building construction, and to the material therefor, as well as to the building puzzles.

The aim of the Applicant for the present application has been to improve further the manufacturing method which has formed the subject matter of the U.S. Pat. No. 2,221,036, of which he is the holder, and which is therefore of the full knowledge of the applicant.

The novel method of assembly has the advantage to provide walls which are of varying thickness, and thus to offer further possibilities in the field of Public Works, beside the enclosure walls and the like which can be made in accordance with the method of the Patent mentioned above. According to this patent, framing walls only could be made, whereas it is possible with the embodiment of the novel method to carry out any designs of weighted walls, of piers, of dam abutments, directly from prefabricated modular elements as defined by the subject invention.

According to the invention, it is possible to make building works with breakings of joints in the three dimensions instead of two as in the foregoing Patent.

According to the subject Application, and in a known manner, the elements are manufactured from conventional concrete of gravels, expanded clay concrete, cellular concrete or any other material which is convenient and well-known in the art, with or without reinforcements. Moreover, they are of varied shape and dimensions, but they are complementary in order that they could be assemblaged and positioned one another so as to form a homogeneous unit, without the need for further finishing touches.

In accordance with a first characteristic, the constituent elements are modular elements which can be used as such or which can be divided into one or more parts, the parallelepipedic and integral standard element being noteworthy for the fact that it includes in the vertical direction three areas which define respectively a solid central core, an upper face having at each one of the corners of said element similar and symmetrical projecting shapes such as right angle frustopyramidal shapes exposing in the central portion and in the upper plane of the core a cruciform recess; the lower face of said element having internally a closed recess which does not protrude over any of the sides, for the engagement with offsetting by a half-length of the projecting parts formed on other similar or divided elements; the volume of said recess permitting moreover the engagement of four projecting parts formed on four different elements at most.

These and other characteristics will be clearly apparent from the following description, with reference to the attached drawings in which the object of the invention is more particularly illustrated, without however limiting it to the forms of embodiment shown therein. In these drawings:

FIG. 1 is a perspective view illustrating a first form of embodiment with the assembly of several integral elements in accordance with the invention;

FIG. 2 is a perspective view illustrating a module 1 standard element;

FIG. 3 is a perspective view illustrating a standard element divided into two modules $\frac{1}{2}$;

FIG. 4 is a perspective view illustrating a module $\frac{1}{4}$ divided standard element;

FIG. 5 is a perspective view illustrating the assembly of module 1 modular elements with module $\frac{1}{2}$ elements;

FIG. 6 is a front view illustrating the facade made with the method and the means of assembly;

FIG. 7 is a sectional view along line VII—VII in FIG. 6;

FIG. 8 is a sectional view along line VIII—VIII in FIG. 7.

Figure 9:
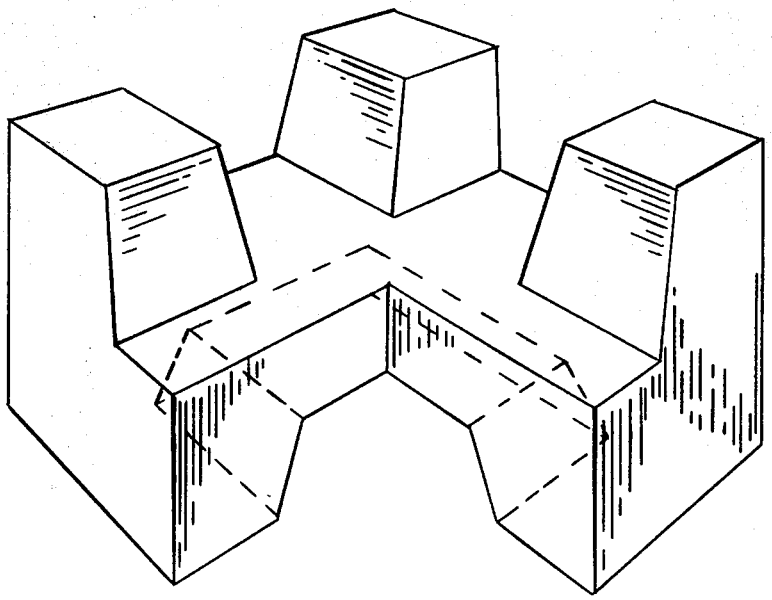
FIG. 9 is a perspective view illustrating a module which is $\frac{3}{4}$ of a standard element.

The object of the invention will be understood more fully by describing it now not limitatively with reference to the examples of embodiment illustrated in the Figures of the drawings.

There is shown in FIG. 2 a standard element 1 in perspective view. This integral or one-piece element includes three areas: a solid central portion $\mathbf{1}^1$; an upper portion $\mathbf{1}^2$ with projections $\mathbf{1}^3$ that are formed and disposed from this upper portion; and a lower portion $\mathbf{1}^4$ having internally a large recess $\mathbf{1}^5$ which does not protrude over any one of the sides of the element. This basic integral or one piece element is made such that it can be fitted in and can cooperate by overlap nesting with one or more other similar elements or one or more elements divided from the basic element.

The integral or one piece element $\mathbf{1}^2$ has at the upper portion thereof at least one projection and preferably several projections $\mathbf{1}^3$ disposed in accordance with one characteristic of the invention at each corner of the modular element. Each projection is made in a profiled shape such as, but not limitatively, a frusto-pyramidal shape. Its sides turned externally $\mathbf{1}^6$ are disposed in the normal extension within the plane of the sides of the modular element, while the internal and adjacent sides $\mathbf{1}^7$ formed in projection are slanted vertically and directed towards the inside of the block. With this disposition and direction, the positioning and engagement one to another of the complementary profiles formed on the other elements are made easier.

In accordance with a further characteristic of the invention, the angularly offset projections define a plane cross-shaped recess $\mathbf{1}^8$ the similar limbs $\mathbf{1}^9$ of which are disposed between two projections $\mathbf{1}^3$ in succession. It will be noted, in an advantageous manner, that the width l of a limb between two projections in succession is at least equal to two times the thickness e of each foothold-forming abutting portion of the modular element adjacent to the internal recess formed within the lower portion of said element. For instance, it will be noted in FIG. 5 that a half element is positioned in overlapping relation upon a basic modular element, while leaving the necessary clearance for positioning a further element of any module.

In accordance with a further characteristic, and as it will be clearly apparent from the Figures of the drawings, the standard element can include in the lower area a profiled internal recess the depth P of which corresponds somewhat on a larger scale to the height h of the angular projections formed within the upper area of the element. Moreover, the recess sides $\mathbf{1}^9$ of the bottom of the recess, together with the lower plane of the element, are slanted and correspond approximately to the slanted profiles $\mathbf{1}^7$ of the inner walls of the protruding bosses of the upper area. With these arrangements, the elements are faultlessly fitted one into another, with an offsetting by the half-length. It will be clearly understood that from a standard element, it is possible to fit axially or at right angles around the four or more projections formed on the modular element one portion at the utmost of four other similar elements which will overlap by means of their lower recess the corresponding angular projection, only in order to form either simple walls with or without partitioning, or other constructions such as piers or the like.

As illustrated in FIGS. 3 and 4, it is also possible to provide modular sub-elements 2 and 3 to the element standard 1. There is shown in FIG. 3 a standard element which is divided by two with only two projections $2^1$ which define a plane T-shaped upper portion $2^2$ and a lower recess $2^3$ opening towards the cut face.

A quarter of standard element 3, module $\frac{1}{4}$, can also be provided as illustrated in FIG. 4, comprising one single projection $3^1$ in the upper portion thereof, with a quarter of recess $3^2$ in the lower portion thereof, opening towards two sides $3^3$, $3^4$. In this case, the upper portion is L-shaped, $3^5$.

In an alternative form of embodiment, each element can be made without the recessed lower portion for the parts that are resting on the ground, in order to provide base parts thereby.

It is also possible to bevel the vertical ridges and to provide a recess at the centre of the standard part; this recess can be used as a gripping means for handling purposes, so as to provide a means of erection which is well known to skilled persons in the art, with the guarantee of a vertical pre-stress.

Finally, it is possible to bevel all of the vertical, oblique, horizontal ridges in an ornemental way, in order to give a more lively appearance to each element.

There has been illustrated in FIG. 5 a mode of assembly wherein it can be seen that half-elements 2 are positioned by superposed nesting upon a modular element 1 and define a regular facade with or without ornemental facing.

There has been illustrated in FIG. 6 a construction obtained in accordance with the method of assembly, with four stacking levels: at level I, a module 1 base element is placed which has no lower recess; at level II, a module $\frac{1}{2}$ half-element is placed and is offset by a half-length of an element; at level III, a module 1 element is positioned and is offset by a half-length of an element, in such a way that the elements of the levels I and III are accurately superposed with an intermediary element therebetween; at level IV, which level, in accordance with this form of embodiment, is considered as being the final upper level, a half-element is placed as a flush part, i.e. as a part which does not include any protruding profile in the upper portion thereof. In accordance with the assembly desired, quarters of modular elements can be advantageously used as angular elements, see FIG. 1 more particularly.

It is also possible, as may be seen in FIG. 1, to provide upper elements 4 which have no external projection running over the upper plane, and a recess for positioning the existing projections upon the underneath elements.

The advantages will be clearly apparent from the description, and more particularly the novel possibilities offered by this method of assembly with breaking of joints in the three dimensions are to be pointed out.

The nesting modular elements and their method of assembly make it possible to take them down completely. Elements on a reduced scale and their method of assembly are also used in the field of playthings.

The invention is not restricted in any way to the use nor the form of embodiment of the various parts thereof which have been more particularly described, and any alternative form of embodiment remains within the scope of the invention.

I claim:

1. Nesting modular elements for use whole or divided into fractions thereof wherein the whole element comprises a solid central core; an upper face having at each corner of the face a symmetrical projecting frustopyramidal projection, the projections forming a cross-shaped recess in the central portion and upper plane of the core; a lower face having a closed recess internally thereof for the engagement of projecting portions of similar modular elements, the volume of the recess permitting engagement of not more than four projecting portions formed upon four different elements, the externally directed sides of the projections being parallel to the sides of the elements and the internal sides of the projections being slanted and directed towards the inside of the elements.

2. Nesting modular elements according to claim 1 wherein the lower area of the element is a profiled internal recess, the depth of which corresponds approximately to the height of the projections formed in the upper part of the element, the connecting recess sides being slanted and corresponding to the slanting sides of the inside walls of the projections.

3. Nesting modular elements according to claim 1 wherein a half-element has two projections in the upper plane which define an upper T-shaped planar portion and a lower recess which opens toward the cut face of the half-element.

4. Nesting modular elements according to claim 1 wherein quarter-elements comprise a projection in the upper plane and define on the upper planar portion an L-shaped form, with a quarter of a recess in the lower portion thereof opening over two sides.

5. Nesting modular elements according to claim 1 wherein a three-quarters element comprises three projections in the upper plane and a three-quarters recess in the lower portion which opens over half-sides.

* * * * *